United States Patent [19]

Wood

[11] Patent Number: 4,724,800

[45] Date of Patent: Feb. 16, 1988

[54] RINGLESS PISTON ENGINE

[75] Inventor: Charles D. Wood, San Antonio, Tex.

[73] Assignee: Southwest Research Institute, San Antonio, Tex.

[21] Appl. No.: 897,102

[22] Filed: Aug. 15, 1986

[51] Int. Cl.[4] ..... F02B 75/20; F01P 3/12

[52] U.S. Cl. ..... 123/59 B; 123/41.02; 123/41.37; 123/197 AC

[58] Field of Search ..... 123/59 B, 197 AC, 41.35, 123/41.37, 41.021, 193 CP, 193 CH, 193 P

[56] References Cited

U.S. PATENT DOCUMENTS

| | | | |
|---|---|---|---|
| 1,237,373 | 8/1917 | Nordberg | 123/59 B |
| 1,852,861 | 4/1932 | Simmen | 123/41.37 |
| 1,922,393 | 8/1933 | Pielstick | 123/41.37 |
| 2,155,068 | 4/1939 | Wati | 123/59 B |
| 3,230,940 | 1/1966 | Hofmann | 123/193 CP |
| 3,413,963 | 12/1968 | Hellingman | 123/41.35 |

FOREIGN PATENT DOCUMENTS

| | | | |
|---|---|---|---|
| 551897 | 5/1932 | Fed. Rep. of Germany | 123/41.37 |

*Primary Examiner*—William A. Cuchlinski, Jr.
*Attorney, Agent, or Firm*—Thomas E. Sisson

[57] ABSTRACT

An non-lubricated, ringless piston engine without a conventional heat exchange system having a cross-head guide for guiding and restraining the piston within a cylinder of a two-stroke engine. The piston-bore radial clearance gap is maintained during engine operation by means of a capacitance sensor controlling a temperature equilibrium flow system within the piston head and the cylinder jacket. The engine operates at high speeds to minimize horsepower losses due to gas leakage, while benefiting from reduced friction losses resulting from absence of piston rings. Blowing gases are collected and returned to the combustion chamber from a pumping chamber formed beneath the piston and above the cross-head guide.

5 Claims, 4 Drawing Figures

RINGLESS PISTON ENGINE

BACKGROUND OF THE INVENTION

This invention relates to reciprocating internal combustion engines, more specifically to two-stroke crankcase scavenged engines. Further, the invention relates to an uncooled crankcase scavenged two-stroke internal combustion engine having a non-lubricated ringless piston.

Well-designed conventional reciprocating engines operating at conservative powers and speeds, irrespective of size or type, generally last about $5\times10^8$ revolutions before wear-out of the piston rings and the cylinder bore. Note that the engine like expectancy is a function of the number of revolutions rather than the total piston travel distance. Such a fact implies that wear-out is primarily due to the ring reversal event, i.e., the reversal in direction of ring travel that occurs twice each revolution. It is well known that maximum bore and ring wear occurs at ring reversal due to the "squeeze-out" of the oil film between the ring and bore when the ring is not moving.

Also, higher piston speed increases wear rates because of the increasing difficulty in maintaining an adequate oil film. It is generally accepted that average piston speed should not exceed about 2000 feet per minute, and low speed engines enjoy a life advantage over high speed engines.

The instant invention prevents any ring/bore wear by removing the piston rings and thus eliminating the contact between the piston and the bore. The resulting leakage of gas around the ringless piston requires corrective measures which are addressed in the instant invention.

The average continuous leakage rate of gas past the piston is about constant irrespective of engine speed. The power and efficiency loss due to gas leakage past the piston is directly proportional to the weight of gas leaked each engine cycle. Therefore, the higher the engine rotational speed, the less gas is leaked each engine cycle, and the less the power and efficiency loss, even though the average continuous leakage rate is high.

In the conventional four-stroke engine, any gases leaked past the piston enter directly into the engine crankcase and contaminate the engine lubricant. At high leakage rates the lubricant is blown out of the crankcase. In the present invention, gas leakage rates are high so it is not feasible to allow these gases to pass directly to the crankcase. However, in a two-stroke engine that uses the underside of the piston to pump air to scavenge the cylinder, any gases leaked past the piston will return to the cylinder via the transfer port without the possibility of lubricant contamination or the necessity for disposal of the leaked gases to the atmosphere.

In conventional engines, piston speed is limited to about 2000 feet per minute. The engine of the instant invention has no such limits. Therefore, it is possible to run the engine very fast, as is required in the present invention. Further, it is desirable to run the instant engine very fast in order to increase the horsepower output without recourse to turbocharging or supercharging.

SUMMARY OF THE INVENTION

The instant invention is a an uncooled two-stroke reciprocating engine utilizing an unlubricated ringless piston and a cross-head guide which prevents significant piston/bore contact. The cross-head guide further operates as a partition separating the pumping chamber from the engine oil sump. Degradation of the crankcase lubricating oil is eliminated because the blow-by gases do not enter the crankcase oil sump. The usual periodic oil change is thereby eliminated or greatly reduced.

The engine of the instant invention operates at a high speed such that gas leakage past the piston does not appreciably degrade the engine power or efficiency. The ringless piston itself does not require lubrication and as a consequence the engine may be uncooled. Further, the instant invention utilizes an isothermal heat transfer system to maintain constant average clearance between the engine piston and engine cylinder wall.

DETAILED DESCRIPTION OF THE PREFERRED EMBODIMENT

Figure 1:
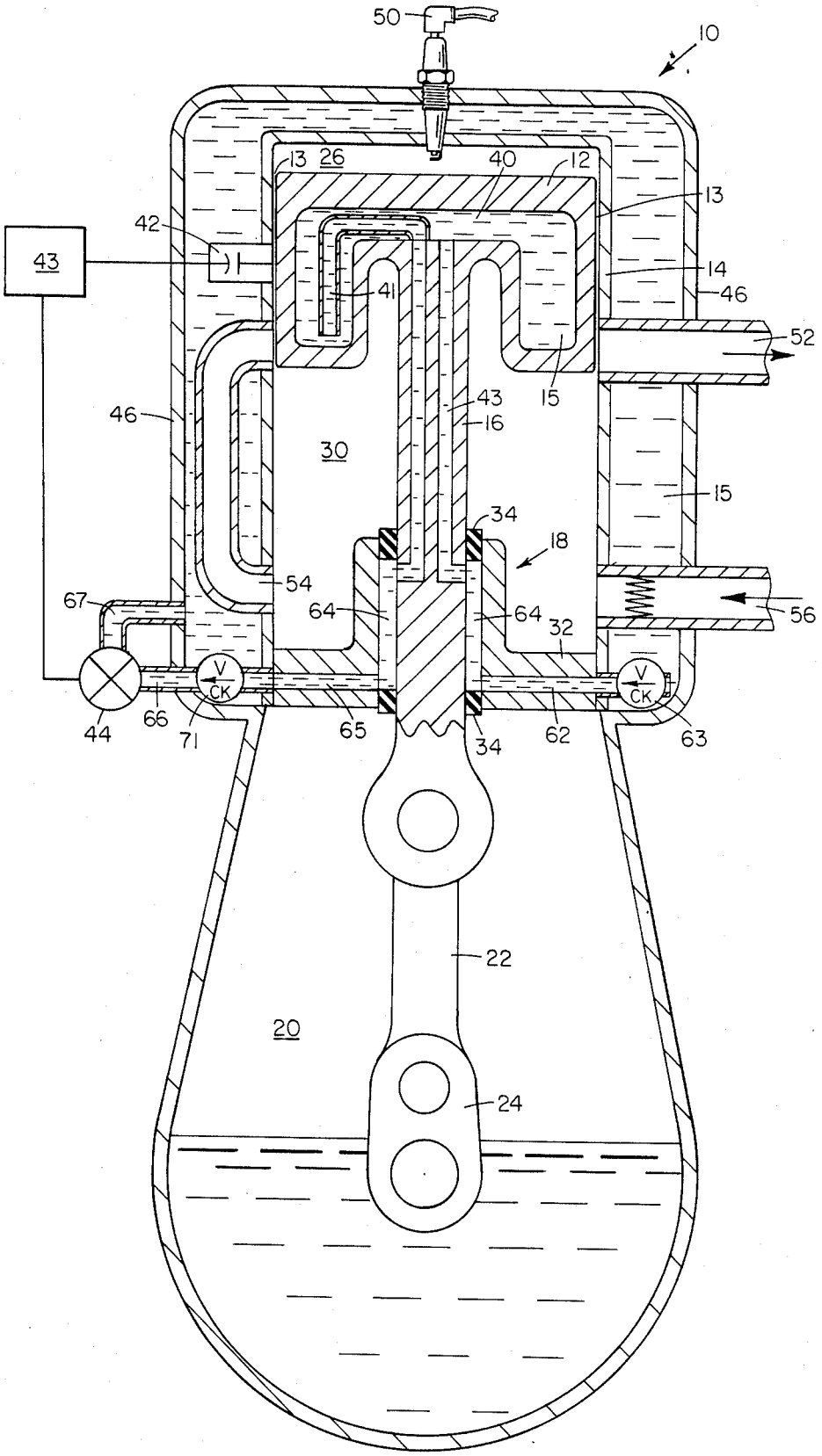
FIG. 1 is a cross sectional view of the engine of the instant invention

FIG. 1 illustrates a single cylinder two-stroke engine embodying the claimed invention. Engine 10 employs a conventional two-stroke cycle. The events in this cycle are also conventional, consisting of an exhaust (via exhaust system 52) and scavenging (via transfer port 54) process when piston 12 is at the bottom dead center followed by compression, combustion, and expansion. While the method of fuel introduction (which could be via intake port 56, or by fuel injection into transfer port 54, or directly into the cumbustion chamber 26, or by other known means) is not specifically described herein, any method acceptable for efficiency and power considerations is considered applicable to this invention. Many such fuel systems are known in the art.

The piston 12 of the instant invention is unlike the conventional engine piston; it has no rings. Further, piston 12 is constrained to move parallel to the bore axis by piston rod 16 reciprocating in cross-head guide 18. Thus, piston 12 is directionally guided and contact between piston 12 and cylinder wall 14 is prevented or else constrained to occur infrequently or during only a short part of the piston stroke, with only very low contact force. Cross-head guide 18 also functions as a partition separating the volume under piston 12, i.e., the pumping chamber 30, from the engine oil sump 20.

Reciprocating motion of piston 12 is produced by the conventional means of connecting rod 22 and crankshaft 24, although other methods known in the art such as a scotch-yoke assembly may be utilized.

In operation, the small clearance 13 between piston 12, and cylinder wall 14, will allow gas to leak from the combustion chamber 26 above piston 12 along wall 14 to pumping chamber 30 below the piston 12. This leakage causes a power loss that decreases as the engine speed increases.

Figure 2:
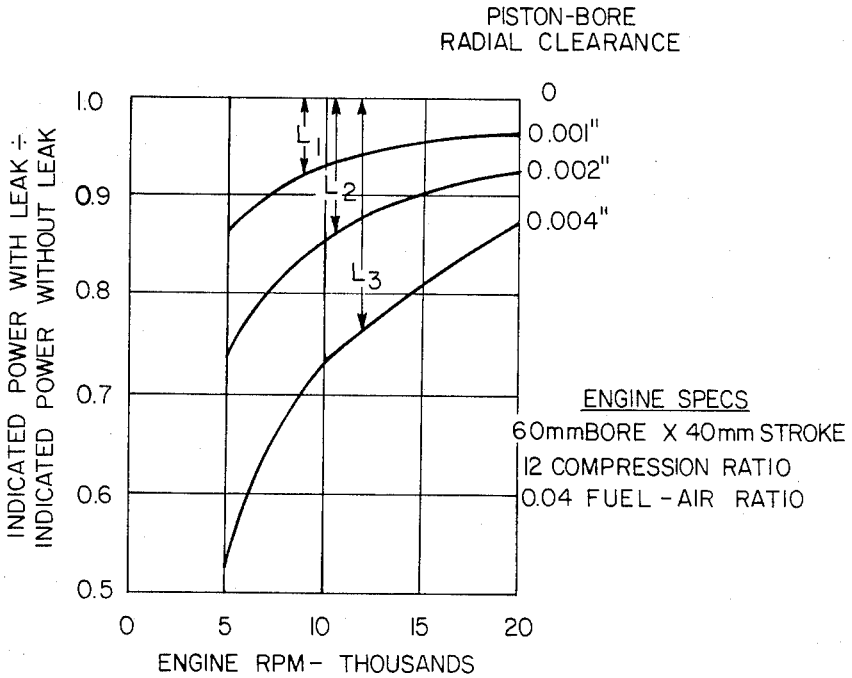
FIG. 2 is a graphic representation of the effect of leakage on indicated horsepower.

FIG. 2 illustrates the effect of such leakage on the indicated horespower, i.e., the power produced by the gas on the piston. Three examples are used to show the leak power loss with different piston-bore radial clearances. The engine used in these examples has a 60 mm bore×40 mm stroke; 12 compression ratio; and 0.04 fuel-air ratio. The point 1.0 on the ordinate of the graph of FIG. 2 represents the indicated engine horsepower with no piston leakage. $L_1$ represents the amount of power loss as a function of engine speed with a piston-bore radial clearance of 0.001". $L_2$ and $L_3$ represent the amount of power loss as a function of engine speed with a piston-bore radial clearance of 0.002" and 0.004", respectively. As can be seen from FIG. 2, as the engine speed is raised, the power losses due to leakage become less.

Figure 3:
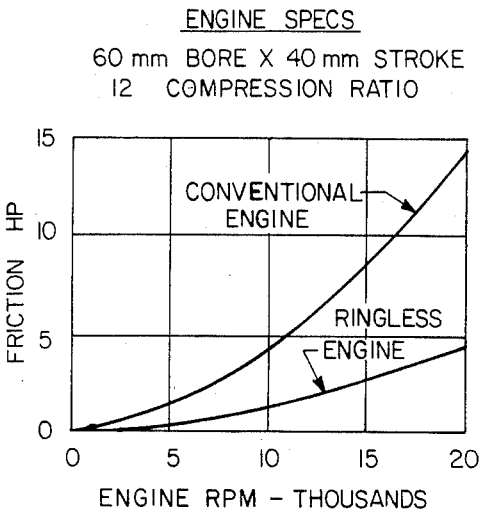
FIG. 3 is a graphic representation of the effects of ring removal on friction horsepower.

FIG. 3 illustrates a comparison of the frictional horsepower losses for a conventional engine and the ringless piston engine of the present invention. As can be seen from FIG. 3, as engine speed increases, the frictional horsepower losses become quite significant in the conventional engine. However, in the ringless piston engine of the present invention, as engine speed increases, the overall frictional horsepower losses are much smaller; there is no ring to bore contact.

Figure 4:
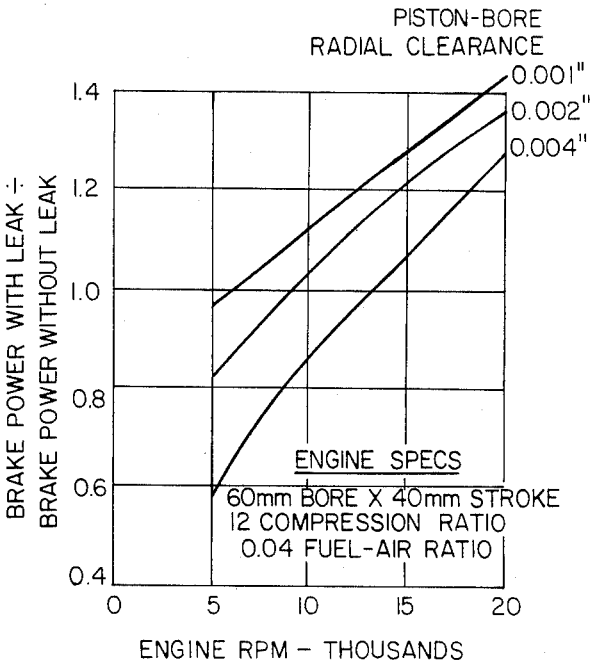
FIG. 4 is a graphic representation of the combined effect of leakage and ring removal on brake horsepower.

FIG. 4 is a graphic illustration which shows the combined effect on the brake horsepower (or net horsepower) as a result of the reduction in indicated horsepower due to leakage plus the reduction in friction horsepower due to the removal of the piston rings. Again, the same three examples used in FIG. 2, are used in FIG. 4. The point 1.0 on the ordinate axis represents the case where the brake horsepower of the ringless engine is equal to the brake horsepower of the conventional engine. FIG. 4 thus shows that at high engine speed there is greater brake horsepower without the rings than with the rings. In other words, when the effects of power loss due to leakage and power gain due to reduced friction are combined, the brake power of the ringless engine is greater than that of the conventional engine at the same speed because the gain is greater than the loss.

Turning again to FIG. 1, during operation of the engine of the instant invention the gases leak past piston 12 and return to the combustion chamber 26 during the scavenging event via transfer port 54. Two-stroke engine 10 has a pumping chamber 30 formed below piston 12 and separated by partition 32 of cross-head guide 18 from the engine oil sump 20. Such an arrangement allows for the sealing of engine oil sump 20 from the combustion gases thereby increasing the oil service life and overall engine life. No other means are necessary for the disposal of leaked gases such as those used in conventional combustion engines.

Cross-head guide 18 is an integral part of partition 32 separating the engine oil sump 20 from the leaked combustion gases. Seals 34 in cross-head guide 18 insures that no blow-by gases enter the sealed oil sump 20.

The instant invention provides for the maintenance of an approximately constant clearance 13 between piston 12 and cylinder wall 14. Maintenance of a constant piston/bore clearance 13 is desirable to assure predictable operation of the engine. In the preferred embodiment, piston 12 and wall 14 are constructed of the same material; thus, by maintaining a constant temperature differential between the wall 14 and piston 12, the piston/bore clearance 13 is kept constant. To achieve this constant temperature gradient, a flow of heat transfer fluid 15 passes through the piston cavity 40. Piston 12 pumps the heat transfer fluid 15 through the system by inertial operation with flow rate controlled by control valve 44. As piston 12 accelerates upwardly, the fluid 15 is forced out the piston cavity 40 via conduit 41 and on the down stroke, the fluid is forced into the cavity 40 via conduit 43 without the need for a separate pump. As previously stated, the purpose of the fluid 15 is to maintain a constant temperature differential between the wall 14 and the piston 12. This is accomplished when the heat transfer fluid 15 circulates between piston 12 and jacket 46, transferring heat from the hotter component to the cooler one. Thus, the engine 10 continues to operate at the same efficiency as long as the wall/piston clearance 13 is maintained constant.

The engine 10 requires no cooling system (radiator and fan) as is conventionally used to transfer heat from the engine to the surrounding atmosphere. No cooling is necessary because there is no film of lubricant between piston rings and cylinder bore as in conventional engines, and since the primary purpose of cooling in conventional engines is to maintain this oil film at a temperature below the temperature where oil degradation begins, the absence of this oil film eliminates the need for cooling.

Sensor 42 is a sensor which measures the distance between piston 12 and wall 14. A sensor that measures the electrical capacitance between sensor 42 and piston 12 can be used to measure the clearance 13, and such capacitance sensors are known in the art and are very accurate in measuring distances. Sensor 42 measures the distance between piston 12 and wall 14 sending its output to a comparator 43 which compares the actual clearance distance to a set point (desired clearance) and controls the flow of heat transfer fluid 15 through the system via control valve 44.

Fluid jacket 46 surrounds cylinder wall 14 and is in fluid communication with piston cavity 40 via conduits 41 and 43. Fluid flow from piston 12 thus goes to fluid jacket 46. Fluid communication is achieved between piston 12 and jacket 46 through a simple circulation system. Input conduit 62 in cross-head guide 18 allows fluid to pass from jacket 46 into reservoir 64. Fluid from jacket 46 passes check valve 63 and into reservoir 64. As piston 12 reciprocates fluid is inertially pumped into piston cavity 40 via piston input conduit 43. Fluid is pumped out of cavity 40 via piston output conduit 41 and into reservoir 64 and then past check valve 71, control valve 44 and through jacket 46.

It should be noted that the fluid 15 within reservoir 64 acts as a lubricant for piston rod 16 as it moves within cross-head guide 18. The fluid system is once filled with a low vapor pressure fluid and sealed.

While combustion within engine 10 in the preferred embodiment is by means of the conventional spark plug 50 system, a diesel combustion system or other types of combustion systems can also be utilized.

The instant invention also utilizes exhaust system 52 commonly known and used with internal combustion engines.

While it has been shown, described and pointed out the fundamental novel features of the invention as applied to a preferred embodiment thereof, it will be understood that various omissions, substitutions and changes in the form and details of the device illustrated and in its operation may be made by those skilled in the art without departing from the spirit of the invention. It is the intention, therefore, to be limited only as indicated by the scope of the claims appended hereto.

What is claimed:

1. A internal combustion engine without conventional means for transferring heat to the surrounding atmosphere comprising:

a. means for introducing a fuel and air mixture into a cylinder of said engine;

b. a non-lubricated, ringless piston connected to a first end of a piston rod and dispositioned to reciprocate within said cylinder, said piston and piston rod guided within and substantially restrained from contacting an inner wall of said cylinder by a cross-head guide, an intermediate section of said piston rod passing through a sealed opening in said cross-head guide, said cross-head guide further separating and isolating said cylinder from a crankcase oil sump of said engine, said cylinder having a pumping chamber formed beneath said piston, said pumping chamber in fluid communication with a combustion chamber above said piston through a transfer port;

c. means for translating reciprocating motion of said piston to rotational motion of an output shaft;

d. means for causing combustion of said fuel and air mixture within said cylinder during a combustion cycle of said engine; and e. a means for exhausting exhaust products of said combustion cycle during an exhaust cycle of said engine.

2. The engine of claim 1 further comprising:

a means for maintaining a generally constant radial clearance gap between said piston and said wall during operation of said engine.

3. The engine of claim 2 wherein said gap clearance maintenance means comprises:

a sensor for sensing the actual distance between said piston and said wall;

a means for comparing said actual distance with a predetermined gap distance; and a means for controlling the temperature differential between said wall and said piston, said control means responsive to an output signal from said comparing means.

4. The engine of claim 3 wherein said means for controlling the temperature differential between said wall and said piston further comprises:

a jacket surrounding said cylinder;

an internal cavity within said piston;

a fluid flow path between said jacket and said cavity; and a control valve in said fluid flow path capable of adjusting the flow of a transfer fluid between said jacket and said cavity in response to said output signal from said comparing means, said flow resulting from said reciprocating motion of said piston.

5. The engine of claim 4 wherein said fluid flow path between said jacket and said cavity further comprises:

an input conduit in fluid communication with said cavity at a first end and in fluid communication with said jacket at a second end, said input conduit having a check valve intermediate said first end and said second end allowing fluid flow through said input conduit and into said cavity; and a discharge conduit in fluid communication with said cavity at an output end and in fluid communication with said jacket at a recycle end, said discharge conduit having a check valve intermediate said output end and said recycle end allowing fluid flow through said discharge conduit and into said jacket.

* * * * *